US006485357B1

(12) United States Patent
Divine

(10) Patent No.: US 6,485,357 B1
(45) Date of Patent: Nov. 26, 2002

(54) DUAL-FEED SINGLE COLUMN DOUBLE-DISK GRINDING MACHINE

(75) Inventor: David L. Divine, Cedarville, MI (US)

(73) Assignee: Divine Machinery Sales, Inc., Lowell, MI (US)

( * ) Notice: Subject to any disclaimer, the term of this patent is extended or adjusted under 35 U.S.C. 154(b) by 32 days.

(21) Appl. No.: 09/651,416

(22) Filed: Aug. 30, 2000

(51) Int. Cl.[7] ..... B24B 7/17

(52) U.S. Cl. ..... 451/58; 451/65; 451/194; 451/195; 451/262; 451/261; 451/461

(58) Field of Search ..... 451/65, 58, 194, 451/195, 262, 461, 14, 19

(56) References Cited

U.S. PATENT DOCUMENTS

| | | | | |
|---|---|---|---|---|
| 79,784 A | | 7/1868 | Snyder | |
| 2,673,423 A | | 3/1954 | Hoyet et al. | |
| 2,690,034 A | | 9/1954 | Laverdisse | |
| 2,746,213 A | | 5/1956 | Laverdisse | |
| 2,757,489 A | | 8/1956 | Touvay et al. | |
| 3,151,422 A | * | 10/1964 | Fallon | 451/14 |
| 3,721,046 A | * | 3/1973 | Dunn | 451/14 |
| 3,774,348 A | * | 11/1973 | Dunn | 451/14 |
| 4,208,842 A | * | 6/1980 | Katzke et al. | 451/262 |
| 4,471,577 A | * | 9/1984 | Ogawa et al. | 451/262 |
| 4,586,296 A | | 5/1986 | Saunders | |
| 4,753,045 A | | 6/1988 | Fetouh et al. | |
| 4,782,631 A | * | 11/1988 | Nishio | 451/262 |
| 5,035,087 A | * | 7/1991 | Nishiguchi et al. | 451/19 |
| 5,934,983 A | * | 8/1999 | Wada et al. | 451/63 |
| 6,152,804 A | * | 11/2000 | Okuyama | 451/19 |

* cited by examiner

*Primary Examiner*—George Nguyen
(74) *Attorney, Agent, or Firm*—Price Heneveld Cooper Dewitt & Litton

(57) ABSTRACT

An adjustable grinding machine for grinding a plurality of first articles, wherein each first article has two substantially opposite surfaces, and a plurality of second articles, wherein each second article has two substantially opposite surfaces. The adjustable grinding machine includes a structural support member, and a first grinder assembly supported from the structural support member, wherein the first grinder is adapted to grind the two surfaces of the first article simultaneously. The adjustable grinding machine further including a second grinder assembly supported from the structural support member, wherein the second grinder is adapted to grind the two surfaces of the second article simultaneously.

20 Claims, 3 Drawing Sheets

DUAL-FEED SINGLE COLUMN DOUBLE-DISK GRINDING MACHINE

BACKGROUND OF THE INVENTION

The present invention relates to an adjustable grinding machine, and in particular to an adjustable grinding machine that includes two double disk grinding assemblies.

Double disk grinding machines are used in applications in which an associated part is simultaneously ground on two separate opposite surfaces which lie in parallel planes. These double disk grinding machines typically include two grinding wheels between which the part is passed. A variety of feed units can be employed to supply parts to deliver parts between the grinding wheels including rotary-type feeders as well as line-type feeders. These disk grinding machines in conjunction with their associated feeds can be large and obtrusive, requiring significant floor space.

The grinding operation can require an operator of the grinding machine to perform several tasks nearly contemporaneously. The operator is required to place parts to be ground into the associated feeder. This is a continuous process requiring constant attention. The operator must also monitor the grinding process in order to determine if the process is being conducted properly. The operator may also be required to monitor output of the grinding machine, as well as occasionally retrieve additional parts to be ground.

Simultaneously producing ground parts that are dissimilar in shape and size requires two separate grinding machines along with two separate feed assemblies. This machinery requires additional floor space for the two separate machines, thereby resulting in additional overhead costs. Further, two separate machines requires at least two separate operators to both feed parts into the associated feeders and to monitor the grinding operations.

A grinding machine is needed that can perform a grinding function on parts of dissimilar shapes and sizes, while reducing overhead costs associated with housing and operational costs.

SUMMARY OF THE INVENTION

One aspect of the present invention is to provide an adjustable grinding machine for grinding a plurality of first articles, wherein each first article has two substantially opposite surface, and a plurality of second articles, wherein each second article has two substantially opposite surfaces. The adjustable grinding machine includes a structural support member, a first grinder assembly supported from the structural support member, wherein the first grinder is adapted to grind the two sides of the first article simultaneously. The adjustable grinding machine further includes a second grinder assembly supported from the structural support member, wherein the second grinder is adapted to grind the two sides of the second article simultaneously.

Another aspect of the present invention is to provide a method of grinding a plurality of first articles, wherein each first article has two substantially opposite surfaces, and a plurality of second articles, wherein each second article has two substantially opposite surfaces. The method includes providing a structural support member, providing a first grinder assembly supported from the structural support member, and providing a first article carrier adapted to deliver the first article to the first grinder assembly. The method also includes delivering a first article to the first grinder assembly via the first article carrier, and grinding the two sides of the first article within the first grinder assembly. The method further includes providing a second grinder assembly supported from the structural support member, wherein the second grinder is capable of being operated autonomously from the first grinder assembly, and providing a second article carrier adapted to deliver the second article to the second grinder assembly. The method still further includes delivering a second article to the first grinder assembly via the second article carrier, and grinding the two sides of the second article within the grinder assembly.

The present inventive adjustable grinding machine and related method allows for a reduction in manufacturing costs by reducing the number of personnel required to monitor two separate grinding functions, and by reducing the floor space required to allow for grinding functions to be performed on two separate and non-identical parts.

These and other advantages of the invention will be further understood and appreciated by those skilled in the art by reference to the following written specification, claims and appended drawings.

DETAILED DESCRIPTION OF PREFERRED EMBODIMENT

Figure 1:
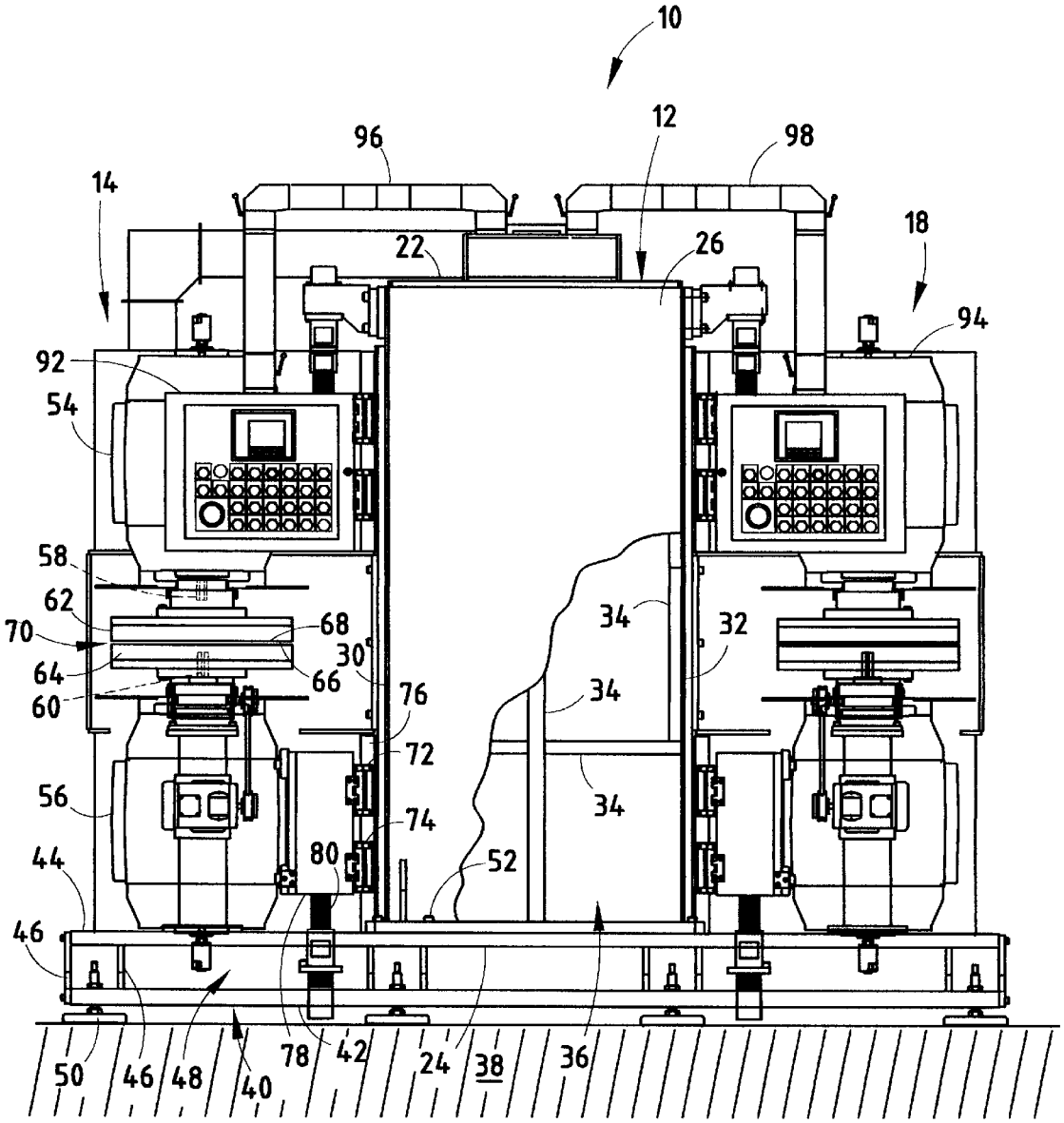
FIG. 1 is a front elevational view on an adjustable grinding machine embodying the present invention.

For purposes of description herein, the terms "upper," "lower," "right," "left," "rear," "front," "vertical," "horizontal," and derivatives thereof shall relate to the invention as oriented in FIG. 1. However, it is to be understood that the invention may assume various alternative orientations and :step sequences, except where expressly specified to the contrary. It is also to be understood that the specific devices and processes illustrated in the attached drawings and described in the following specification are exemplary embodiments of the inventive concepts defined in the appended claims. Hence, specific dimensions and other physical characteristics relating to the embodiments disclosed herein are not to be considered as limiting, unless the claims expressly state otherwise.

The reference numeral 10 (FIG. 1) generally designates an adjustable grinding machine embodying the present invention. In the illustrated example, grinding machine 10 is provided in the form of a dual-feed, single column, double-disk grinding machine. Grinding machine 10 is adapted to grind a plurality of first articles (not shown), wherein each first article has two substantially opposite surfaces, and a plurality of second articles (not shown), wherein each second article has two substantially opposite surfaces, as discussed below. Grinding machine 10 includes a structural support member or column 12, and a first grinder assembly 14. First grinder assembly 14 is adapted to grind the two surfaces of the first article simultaneously. Grinding machine 10 also includes a first article carrier 16 (FIG. 2) adapted to deliver the first article to first grinder assembly 14. Grinding machine 10 further includes a second grinder assembly 18 supported from structural support member 12, and which is adapted to grind the two surfaces of the second article simultaneously. Grinding machine 10 still further includes a second article carrier 20 adapted to deliver the second article to second grinder assembly 18.

The structural support member 12 is provided a box-like shape and includes a top wall 22, a bottom wall 24, a front wall 26, a rear wall 28, a first side wall 30, and a second side wall 32. A plurality of structural support beams extend along walls 22, 24, 26, 28, 30 and 32 of structural support member 12 in order to provide structural reinforcement and rigidity thereto. Structural support member 12 and its related components are constructed of a high strength steel, however, other materials providing sufficient structural support may be used. Walls 22, 24, 26, 28, 30 and 32 define an interior space 36 that is adapted to receive a weighting substance such as sand therein which increases the overall weight of the structural support member 12, thereby dampening any vibrational affects created by first grinding assembly 14 and second grinding assembly 18, and ensuring that any vibrations created by first grinding assembly 14 is not transferred to second grinding assembly 18, and vice versa.

The structural support member 12 is supported above the ground 38 by a base member 40. Base member 40 includes a lower plate 42 and an upper plate 44. Lower plate 42 and upper plate 44 of base member 40 are divided by a plurality of structural support ribs 46 that extend therebetween and which define a space 48 between lower plate 42 and upper plate 44 within which hydraulic hoses and other necessary operational elements may be routed. Lower plate 42 is supported above the ground 38 by a plurality of adjustable legs 50. Adjustable legs 50 may be adjusted so as to level grinding machine 10 during set-up. Structural support member 12 is supported by upper plate 44 and is attached thereto by a plurality of bolts 52.

The first grinder assembly 14 and second grinder assembly 18 are similar in construction and orientation, therefore, a description of first grinder assembly 14 is provided as an exemplary description of both first grinder assembly 14 and second grinder assembly 18. First grinder assembly 14 includes a first grinding wheel drive motor 54 and a second grinding wheel motor 56. First grinding wheel drive motor 54 includes a power shaft 58 and is adjustably supported from structural support member 12 such that power shaft 58 extends downwardly from first grinding wheel drive motor 54. Second grinding wheel drive motor 56 includes a power shaft 60 and is adjustably supported from structural support member 12 such that power shaft 60 extends upwardly from second grinding wheel drive motor 56. First grinding wheel drive motor 54 and second grinding wheel drive motor 56 are supported from structural support member 12 such that power shaft 58 and power shaft 60 are coaxially located. First grinding wheel drive motor 54 is operably connected to a first grinding wheel 62, and second grinding wheel drive motor 56 is operably connected to a second grinding wheel 64. First grinding wheel 62 includes a grinding surface 66, while second grinding wheel 64 includes a grinding surface 68. Grinding surface 66 and grinding surface 68 define a grinding area 70 therebetween.

The first grinding wheel drive motor 54, second grinding wheel drive motor 56, and the grinding wheel drive motor 54, second grinding wheel drive motor 56, and the grinding wheel drive motors associated with the second grinder assembly 18 are each adjustably supported from structural support member 12 in a similar fashion, therefore, a description of second grinding wheel drive motor 56 and the related connections will be provided as an exemplary description of first grinding wheel drive motor 54, second grinding wheel drive motor 56, and the drive motors associated with second grinding assembly 18. Second grinding wheel drive motor 56 is adjustably supported from structural support member 12 by a first slide linkage 72 and a second slide linkage 74. First slide linkage 72 and second slide linkage 74 slidably engage a slide rail 76 that is fixedly attached to side wall 30 of structural support member 12. First slide linkage 72 and second slide linkage 74 are fixedly attached to a servo-driven gear box 78 that drives along a shaft 80 that is fixedly supported by upper plate 44 of base 40. Second grinding wheel drive motor 56 is fixedly attached to servo-driven gear box 78, such that as servo-driven gear box 78 is driven along shaft 80, first slide linkage 72 and second slide linkage 74 slide along slide rail 76, thereby moving second grinding wheel drive motor 56 and second grind wheel 64 in a vertical direction. In this manner, the location of the first grinding wheel drive motor 54 and second grinding wheel drive motor 56 can be adjusted along structural support member 12 to adjust the distance between first grinding wheel 62 and second grinding wheel 64.

Figure 4:
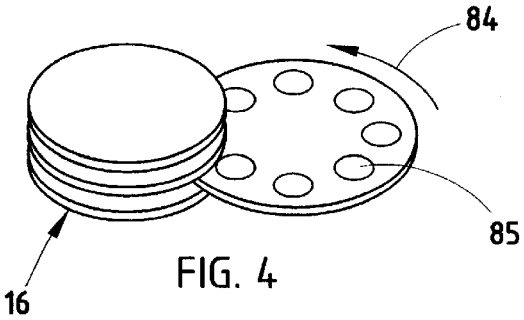
FIG. 4 is a schematic view of a rotary carrier feed.

In the illustrated example, first article carrier 16 (FIGS. 2 and 4) is provided in the form of a turn-style feed that includes a work table 82 that travels along a path in a direction 84 that extends between first grinding wheel 62 and second grinding wheel 64. Work table 82 includes a plurality of recesses 85 adapted to securely hold the first articles to be ground therein. Work table 82 is driven by a variable speed carrier drive motor 86 that is operably linked thereto.

Figure 5:
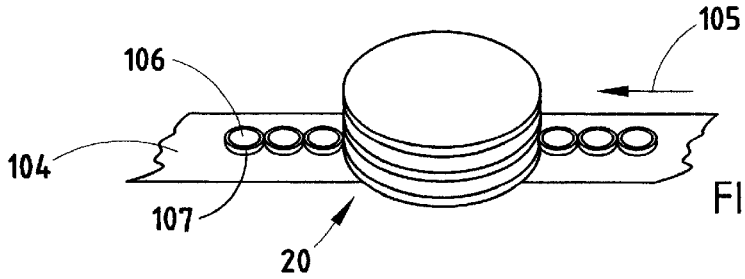
FIG. 5 is a schematic view of a thru-feed.

As illustrated, second article carrier 20 (FIGS. 2 and 5) includes a line-style feed. Second article carrier 20 includes a conveyor frame 102 along which a conveyor work surface 104 moves in a direction indicated by arrow 105 is driven by a variable speed conveyor motor similar to carrier drive motor 86. The work surface 104 includes a plurality of recesses 106 within a plurality of carriers 107 which are adapted to securely hold the second articles to be ground therein. In operation, the carriers 107 push each other between the grinding wheels associated with second grinder assembly 18. It should be noted that while a turn-style type feed and a line-style type feed have been illustrated, other known parts-feeding carriers or loaders may also be utilized, such as a face cut with oscillating feed and face cut with reciprocating feed.

A controller 88 is used to control grinding machine 10. More specifically, controller 88 is in electrical communication with an electrical box 90 via a plurality of electrical communication lines (not shown) that extend through an overhead housing 89. Electrical box 90 is in electrical communication with first grinding wheel drive motor 54, second grinding wheel drive motor 56, the drive motors associated with second grinder assembly 18, carrier drive motor 86, and the carrier drive motor associated with an article carrier 20. A first input control panel 92 associated with first grinder assembly 14 and first article carrier 16, and a second input control box 94 associated with second grinder assembly 18 and second article carrier 20 are moveably supported from structural support member 12 via a first radial arm 96 and a second radial arm 98, respectively. First input control panel 92 and second input control panel 94 are in electrical communication with electrical box 90.

Figure 2:
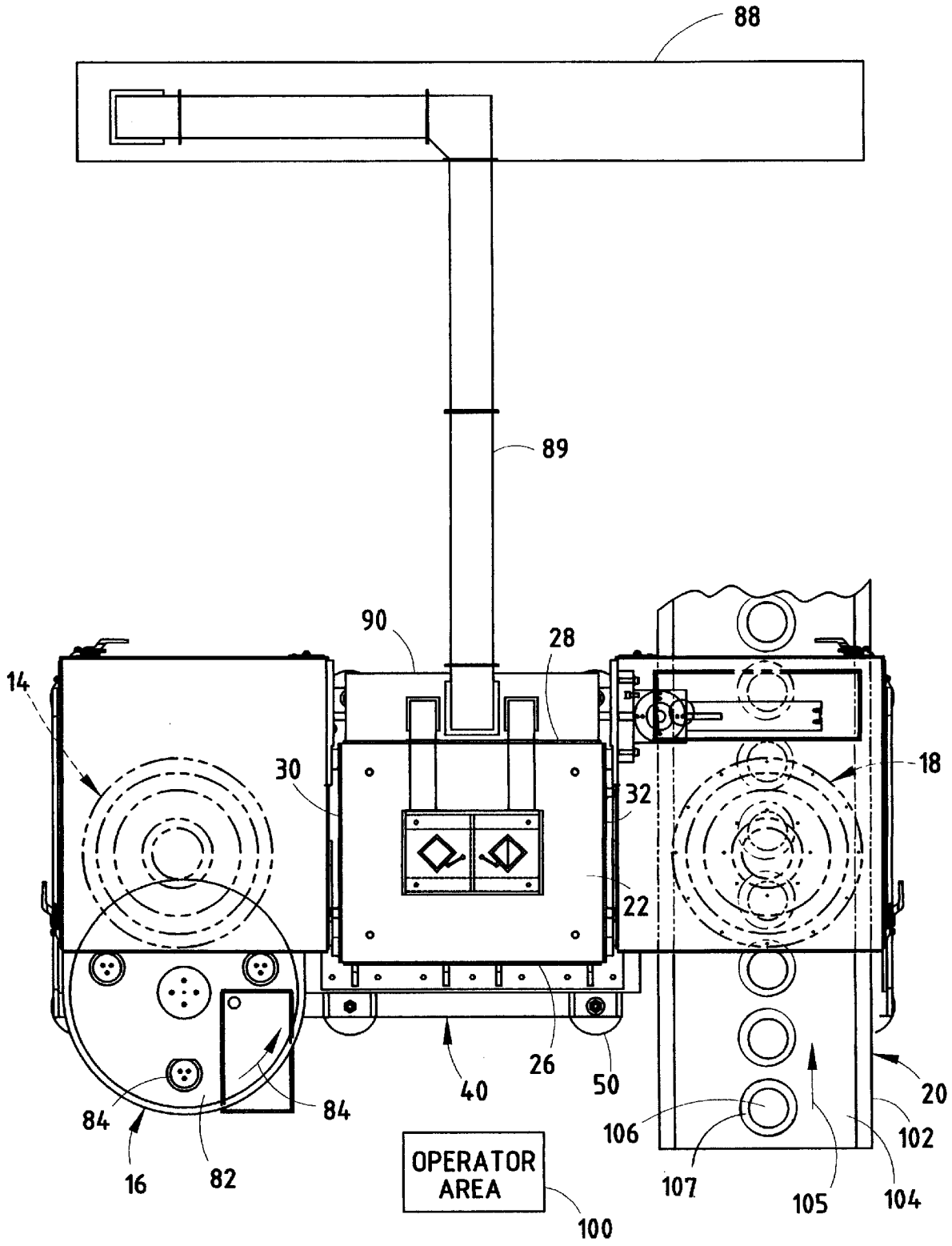
FIG. 2 is a top plan view of the adjustable grinding machine.
Figure 3:
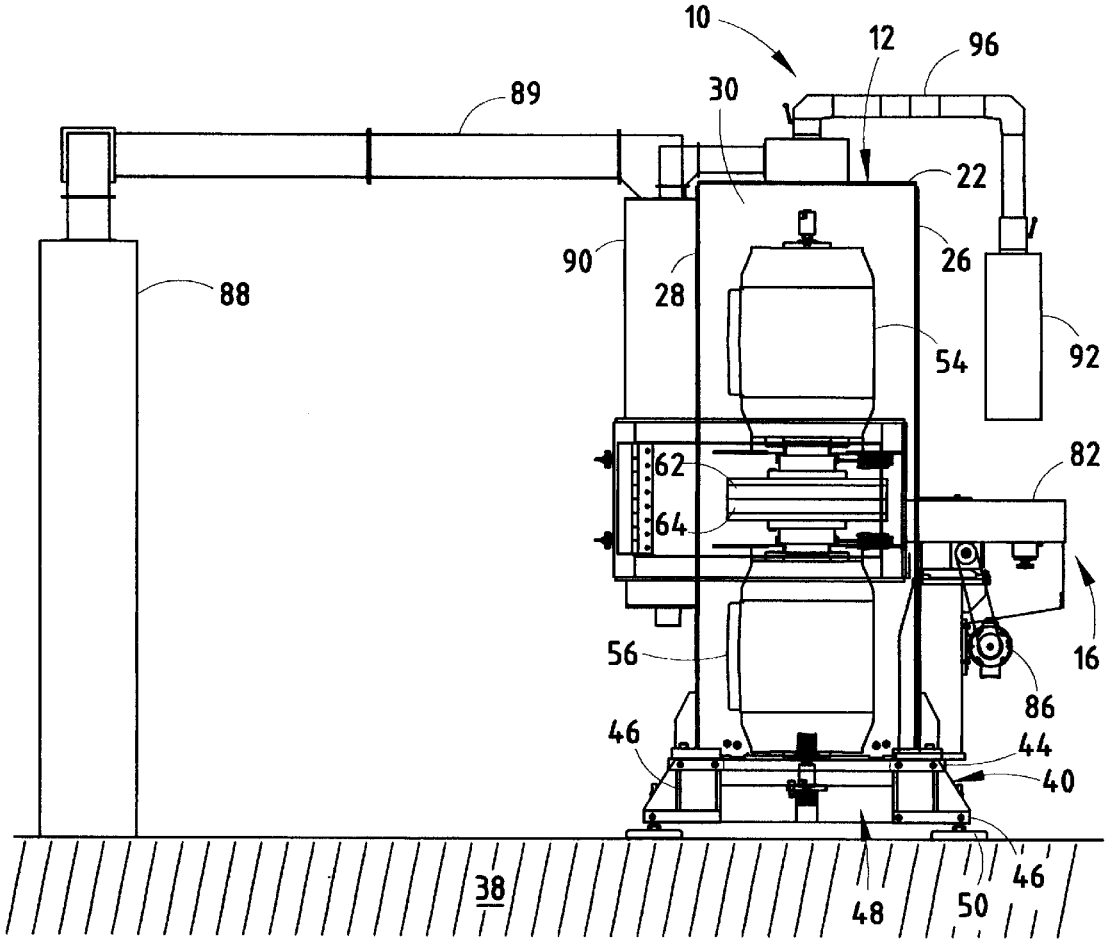
FIG. 3 is side elevational view of the adjustable grinding machine.

By providing first grinding assembly 14 and second grinding assembly 18 which are separately adjustable, grinding machine 10 can simultaneously grind two separate pieces of different shapes and sizes. The layout and construction of grinding machine 10 allows a single operator located within an operator area 100 (as shown in FIG. 2) to simultaneously control first grinder assembly 14, first article carrier 16, second grinder assembly 18 and second article carrier 20, while also observing the same. Grinding machine 10 not only reduces the amount of personnel required to operate and monitor two separate grinding operations of two completely separate and non-identical parts, but also reduces the amount of floor space required to house separate grinding machines that would be required to execute similar operations.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The invention claimed is:

1. An adjustable grinding machine for grinding a plurality of first articles, wherein each first article has two substantially opposite surfaces, and a plurality of second articles, wherein each second article has two substantially opposite surfaces, comprising:

a structural support member;

a first grinder assembly adjustably supported from the structural support member by a first servo-driven gear box operably connected to the structural support member, the first grinder assembly includes a first grinding wheel drive motor operably connected to a first grinding wheel, and a second grinding wheel drive motor operably connected to a second grinding wheel, wherein the first grinding wheel and the second grinding wheel are substantially co-axially located, and wherein the first grinder assembly is adapted to grind the two surfaces of the first article simultaneously; and a second grinder assembly, adjustably supported from the structural support member by a second servo-driven gear box, and wherein the second grinder assembly is adapted to grind the two surfaces of the second article simultaneously.

2. The adjustable grinding machine of claim 1, wherein the second grinder assembly includes a third grinding wheel drive motor operably connected to a third grinding wheel, and a fourth grinding wheel drive motor operably connected to a fourth grinding wheel, and wherein the third grinding wheel and the fourth grinding wheel are substantially co-axially located.

3. The adjustable grinding machine of claim 2, wherein at least a selected one of the third grinding wheel drive motor and the fourth grinding wheel drive motor is adjustably supported from the structural member.

4. The adjustable grinding machine of claim 3, wherein the third grinding wheel drive motor and the fourth grinding wheel drive motor are adjustably supported from the structural member.

5. The adjustable grinding machine of claim 4, wherein the third grinding wheel driver motor is adjustable supported from the structural support member via a third servo-driven gear box operably connected to the structural support member, and the fourth grinding wheel drive motor is adjustably supported from the structural support member via a fourth servo-driven gear box operably connected to the structural support member.

6. The adjustable grinding machine of claim 5, further including:

a first article carrier adapted to deliver the first article to the first grinder assembly.

7. The adjustable grinding machine of claim 6, wherein the first article carrier includes a continuous flow carrier adapted to move the plurality of first articles between the first grinding wheel and the second grinding wheel.

8. The adjustable grinding machine of claim 7, wherein the first article carrier includes a rotary carrier feed.

9. The adjustable grinding machine of claim 7, wherein the first article carrier includes a thru-feed.

10. The adjustable grinding machine of claim 7, further including:

a second article carrier adapted to deliver the second article to the second grinder assembly.

11. The adjustable grinding machine of claim 10, wherein the second article carrier includes a continuous flow carrier adapted to move the plurality of second articles between the third grinding wheel and the fourth grinding wheel.

12. The adjustable grinding machine of claim 11, wherein the second article carrier includes a rotary carrier feed.

13. The adjustable grinding machine of claim 11, wherein the second article carrier includes a thru-feed.

14. A method of grinding a plurality of first articles, wherein each first article has two substantially opposite surfaces, and a plurality of second articles, wherein each second article has two substantially opposite surfaces, comprising:

providing a structural support member;

providing a first grinder assembly that includes a first grinding wheel drive motor operably connected to a first grinding wheel, and a second grinding wheel drive motor operably connected to a second grinding wheel, wherein the first grinding wheel and the second grinding wheel are substantially co-axially located, and wherein the first grinding wheel drive motor is adjustably supported from the structural support member by a first servo-driven gear box operably connected to the structural support member, and the second driving wheel drive motor is adjustably supported from the structural support member by a second servo-driven gear box operably connected to the structural support member such that a distance between the first grinding wheel and the second grinding wheel is adjustable;

providing a first article carrier adapted to deliver the first article to the first grinder assembly;

delivering a first article to the first grinder assembly via the first article carrier;

grinding the two surfaces of the first article within the first grinder assembly;

providing a second grinder assembly that includes a third grinding wheel drive operably connected to a third grinding wheel, and a fourth grinding wheel drive operably connected to a fourth grinding wheel, wherein the third grinding wheel and fourth grinding wheel are substantially coaxially located, and wherein the third grinding wheel drive motor is adjustably supported from the structural support member by a third servo-driven gear box operably connected to the structural support member and the fourth grinding wheel drive motor is adjustably supported from the structural support member by a fourth servo-driven gear box operably connect to the structural support member, such that a distance between the third grinding wheel and the fourth grinding wheel is adjustable, and wherein the second grinder capable of being operated autonomously from the first grinder assembly.

adjusting the distance between the third grinding wheel and the fourth grinding wheel prior to the step of grinding the second article;

providing a second article carrier adapted to deliver the second article to the second grinder assembly;

delivering a second article to the first grinder assembly via the second article carrier; and grinding the two surfaces of the second article within the second grinder assembly.

15. The method of claim 14, wherein the first article carrier providing step includes providing a first continuous flow carrier that moves the plurality of first articles between the first grinding wheel and the second grinding wheel.

16. The method of claim 15, wherein the first article carrier providing step includes providing a rotary carrier feed.

17. The method of claim 15, wherein the first article carrier providing step includes providing a thru-feed.

18. The method of claim 15, wherein the second article carrier providing step includes providing a second continuous flow carrier that moves the plurality of first articles between the third grinding wheel and the second grinding wheel.

19. The method of claim 18, wherein the first article carrier providing step includes providing a rotary carrier feed.

20. The method of claim 18, wherein the first article carrier providing step includes providing a thru-feed.

* * * * *

UNITED STATES PATENT AND TRADEMARK OFFICE

CERTIFICATE OF CORRECTION

PATENT NO. : 6,485,357 B1 
DATED : November 26, 2002
INVENTOR(S) : David L. Divine It is certified that error appears in the above-identified patent and that said Letters Patent is hereby corrected as shown below:

Column 2,
Line 41, delete ":" (colon).

Column 5,
Line 55, "adjustable" should be -- adjustably --.

Signed and Sealed this

Twenty-fourth Day of June, 2003

JAMES E. ROGAN
*Director of the United States Patent and Trademark Office*